US006058616A

United States Patent [19]

Bubits

[11] Patent Number: 6,058,616

[45] Date of Patent: May 9, 2000

[54] SIGHTING DEVICE FOR SMALL ARMS

[75] Inventor: Wilhelm Bubits, Brunn/Gebirge, Austria

[73] Assignee: Steyr-Daimler-Puch Aktiengesellschaft, Vienna, Austria

[21] Appl. No.: 09/125,804

[22] PCT Filed: Feb. 25, 1997

[86] PCT No.: PCT/AT97/00033

§ 371 Date: Aug. 24, 1998

§ 102(e) Date: Aug. 24, 1998

[87] PCT Pub. No.: WO97/32176

PCT Pub. Date: Sep. 4, 1997

[30] Foreign Application Priority Data

| | | | |
|---|---|---|---|
| Feb. 26, 1996 | [AT] | Austria | 345/96 |
| Jul. 30, 1996 | [AT] | Austria | 1360/96 |

[51] Int. Cl.[7] ..... F41G 1/01; F41G 1/32

[52] U.S. Cl. ..... 33/261; 33/241

[58] Field of Search ..... 42/100; 33/241, 33/261

[56] References Cited

U.S. PATENT DOCUMENTS

| | | | |
|---|---|---|---|
| 1,358,015 | 11/1920 | Pen | 42/100 |
| 1,363,553 | 12/1920 | Barringer | 42/100 |
| 2,256,411 | 9/1941 | Russell | 33/241 |
| 2,488,836 | 11/1949 | Sweetman | 33/241 |
| 2,610,405 | 9/1952 | Dickinson | 42/100 |
| 2,706,335 | 4/1955 | Munsey | 33/241 |
| 3,192,632 | 7/1965 | Stavenhagen | 33/247 |
| 3,678,590 | 7/1972 | Hayward | 33/241 |
| 3,820,248 | 6/1974 | Hayward | 33/241 |
| 5,065,538 | 11/1991 | Allen | 42/100 |
| 5,426,882 | 6/1995 | Dornaus | 33/260 |
| 5,878,521 | 3/1999 | Warnock | 42/100 |

FOREIGN PATENT DOCUMENTS

| | | |
|---|---|---|
| 379447 | 1/1986 | Austria . |
| 332634 | 5/1903 | France . |
| 342645 | 4/1904 | France . |
| 397127 | 6/1923 | Germany . |
| 453656 | 12/1927 | Germany . |
| 2126068 | 12/1972 | Germany . |

*Primary Examiner*—Charles T. Jordan
*Assistant Examiner*—Denise J Buckley
*Attorney, Agent, or Firm*—Bachman & LaPointe, P.C.

[57] ABSTRACT

An aiming device for handheld firearms comprises a rear notch sight and a front sight, in which case the rear notch sight (1) has an essentially trapezoidal rear notch sight cutout (6) which diverges downward from an upper edge (5), and the front sight (2) has an essentially triangular outline whose upper tip (10) bisects the upper side (7) of the trapezoidal rear notch sight cutout (6), so that an unobstructed gap (15, 16) is formed in each case between the sides (8, 9) of the trapezoidal rear notch sight cutout (6) and the sides (11, 12) of the triangular outline of the front sight (2). This provides an aiming device which quickly and unambiguously points the eye at the target while aiming.

4 Claims, 2 Drawing Sheets

SIGHTING DEVICE FOR SMALL ARMS

Figure 1:
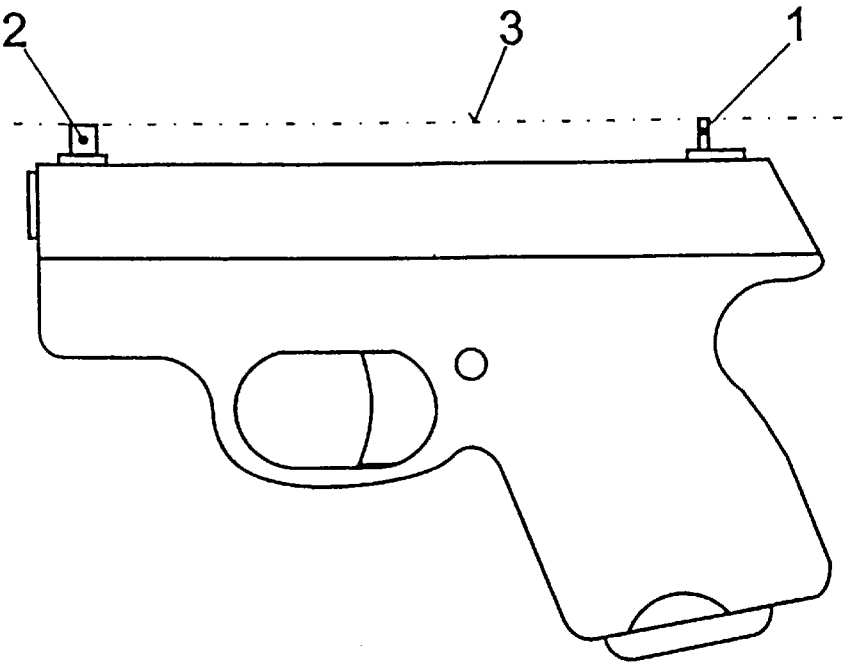

The invention relates to an aiming device for handheld firearms which comprises a rear notch sight and a front sight in which case there are unobstructed gaps between the mutually facing boundaries of the rear notch sight and the front sight, in which case the rear notch sight has an essentially trapezoidal rear notch sight cutout which diverges downward from an upper edge, and the front sight has an essentially triangular outline, whose upper tip, when the weapon is being aimed, bisects the upper side of the trapezoidal rear notch sight cutout, so that an unobstructed gap is formed in each case between the sides of the trapezoidal rear notch sight cutout and the sides of the triangular outline of the front sight.

DE 21 26 068 A discloses an aiming device in which, in various versions, the rear notch sight and front sight have mutually matching (circular, diamond-shaped or X-shaped) contours and thus, when being aimed at the target, form at least two pairs of unobstructed gaps which include an angle between them. A pair of unobstructed gaps is associated with both the horizontal and the vertical discrepancy, so that both discrepancies are perceived in the same way. However, this is actually disadvantageous since, when aiming at the target being pointed at, the pairs of unobstructed gaps lead the eye away from the target toward the angles. On-the-dot aiming at the target is thus impossible. If the target is passed over rather than being aimed at directly, then a considerable part of the target is covered by the large-area front sight, thus impeding target acquisition. This not only delays target acquisition but also leads to aiming errors.

FR-A 342 645 discloses an aiming device of this generic type in which the front sight has a triangular outline and the rear notch sight has a cutout which forms unobstructed gaps or triangles together with the front sight, which disappear when the azimuth aiming errors are very small. Thus, overall, the unobstructed gaps are too narrow to hold a target point, in particular a moving target point, in position during (azimuth) aiming and to guide the eye to the target point, which is considerably further away, at the same time as matching the unobstructed gaps, and to provide an adequate view of the target point. This aiming at the target point and matching of the gaps requires the eye to accommodate alternately at different distances.

AT 379 447 B discloses a U-shaped aiming aid with contrasting colors. However, it surrounds a conventional rear notch sight cutout at a suitable distance. Quick, accurate target acquisition is thus impossible since, owing to the contrast point which is fitted to the front sight at medium height, the view of the eye is not guided to the critical upper edge of the aiming device.

The object of the invention is thus to provide an aiming device which quickly and unambiguously guides the eye to the target while aiming and which at the same time covers the target as little as possible.

As claimed in the invention, this is achieved in that the unobstructed gaps are inclined at about 45 degrees to the vertical, wherein contrast strips are arranged in the upper region of the rear notch sight and of the front sight and entirely or partially line the sides of the trapezoidal rear notch sight cutout and the sides of the triangular outline of the front sight.

As a result of the inclination of the unobstructed gaps at about 45° to the vertical, aiming errors in both the elevation direction and in the azimuth direction have the same influence on the width of the unobstructed gaps and, when accommodating from a short distance (the front sight) to a long distance, the eye is automatically drawn toward the target. The two converging unobstructed gaps which are produced between the sides of the trapezoidal rear notch sight cutout and the sides of the triangular outline of the front sight lead the eye—assisted considerably by the contrast strips—toward the target and, in addition, are used for horizontal adjustment. The contrast strips as claimed in the invention play an important role in matching of the unobstructed gaps and in target acquisition since, when the target is brightly illuminated, they bound the edges of the unobstructed gaps and, when the target is dark, they cause it to be better emphasized.

The contrast strip on the leaf of the rear notch sight and on the front sight is advantageously provided with luminous inserts (claim 4). These allow an aiming image to be identified even in darkness.

It is within the context of the invention for the sides of the essentially trapezoidal rear notch sight cutout and the sides which originate from the tip of the front sight to both run in a curved shape. In this way, the unobstructed gaps are given a curved profile which is used for adaptation to particular requirements, as well as to counteract diffraction and reflections. The sides may have concave curvature in order to guide the view better.

Figure 2:
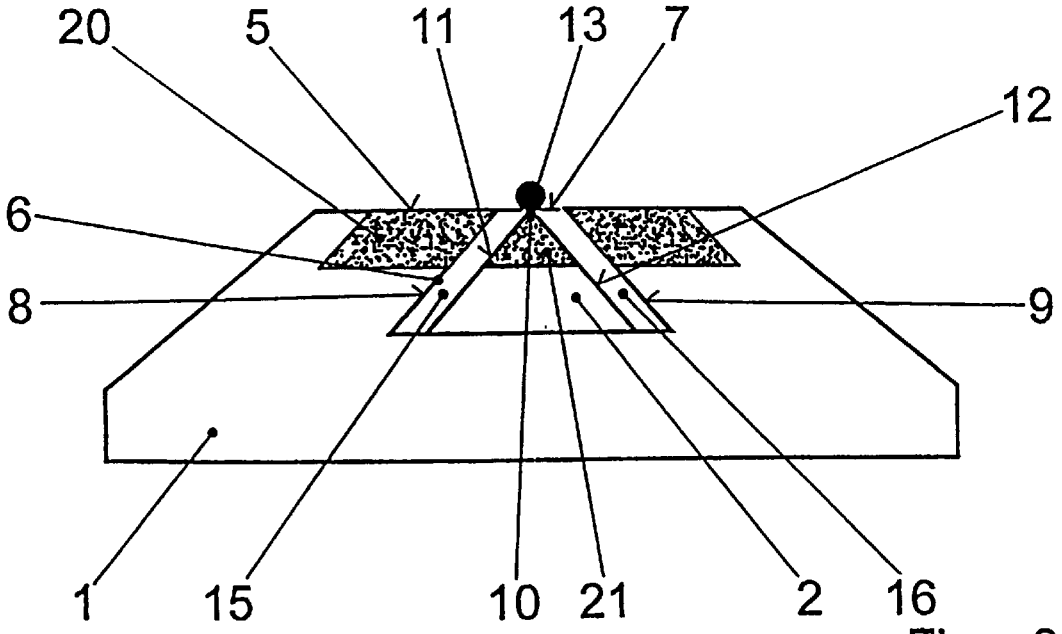
Figure 3:
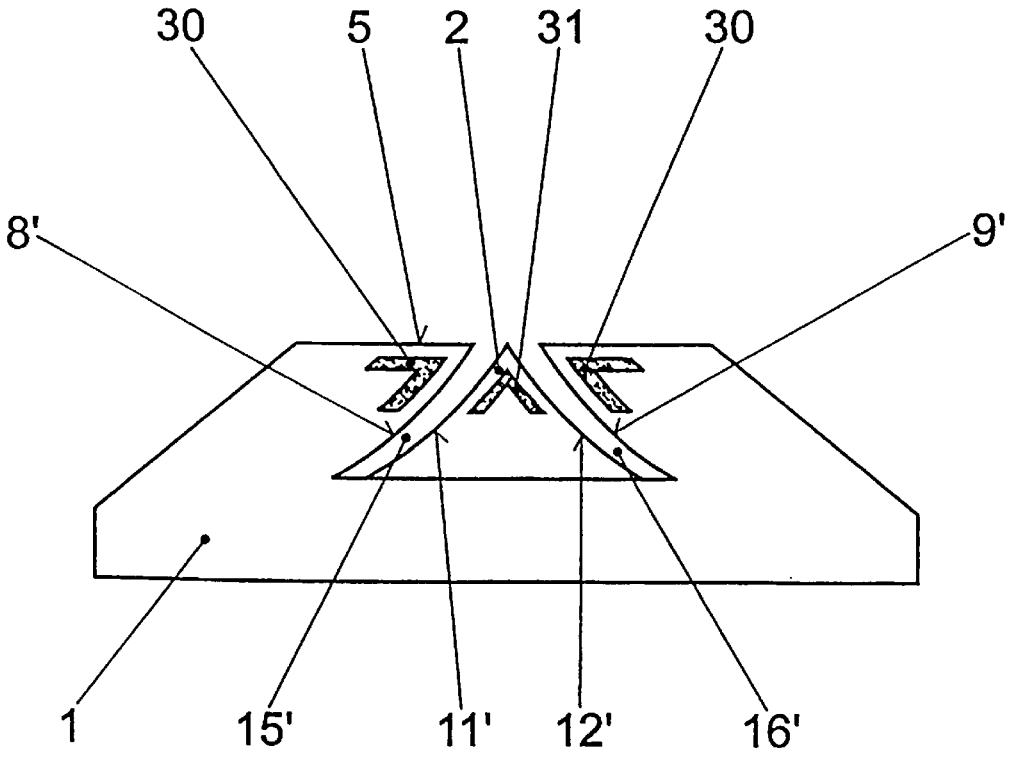
Figure 4:
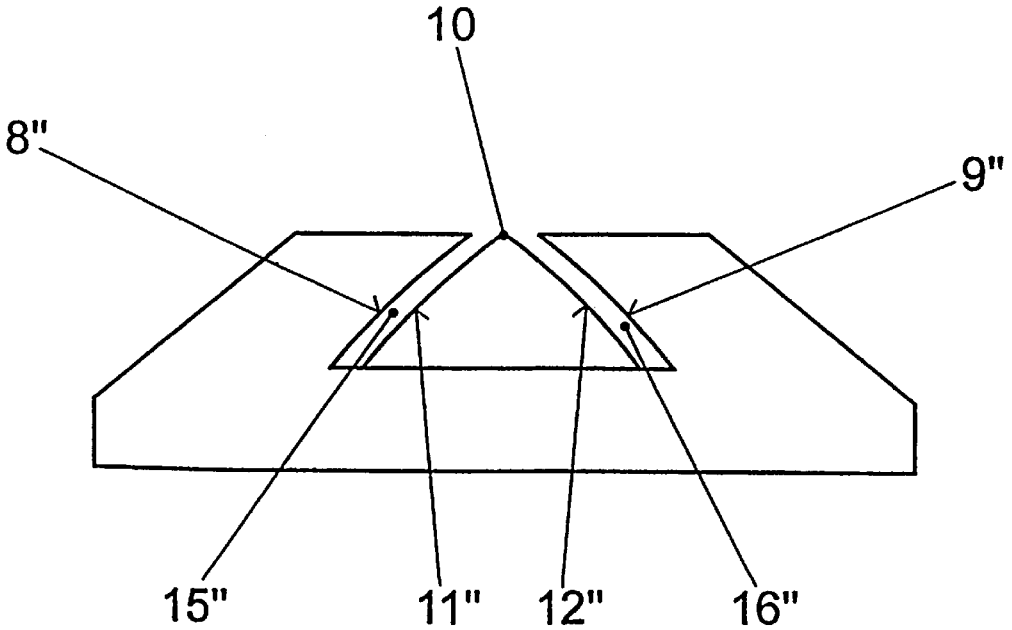

The invention is described and explained in the following text with reference to Figures, in which:

FIG. 1: shows, by way of illustration, a pistol having an aiming device as claimed in the invention, FIG. 2: shows a first embodiment of an aiming device as claimed in the invention, FIG. 3: shows a second embodiment of an aiming device as claimed in the invention, FIG. 4: shows a third embodiment of an aiming device as claimed in the invention.

By way of example, FIG. 1 shows any sort of pistol, but this could also be a long gun as well. A rear notch sight 1 is fitted at the end closer to the person firing the weapon, and a front sight 2 is fitted to the front end of the weapon. These sights define an aiming axis 3.

The rear notch sight 1 is a transverse metal leaf, therefore also called a rear notch sight leaf, having an upper edge 5 from which a trapezoidal rear notch sight cutout 6 projects, which widens downward. The upper side 7 of the trapezoid lies on the upper edge.

The two sides 8, 9 are inclined outward, for example at 45°.

The visible part of the front sight 2 is formed by a triangular prism whose tip 10 bisects the upper side of the trapezoidal cutout 6 when the weapon is being aimed at the target. From this cutout 6, the sides 11, 12 extend downward parallel to the sides 8, 9 of the rear notch sight. They form a first unobstructed gap 15 and a second unobstructed gap 16. The two unobstructed gaps lead upward directly to the target point 13 (for example the center of a range target).

The aiming axis 3 in FIG. 1 runs from the center of the upper side 7 of the rear notch sight 1 to the upper tip 10 of the front sight 2.

A horizontal contrast strip 20 is fitted on the front side of the rear notch sight 1 and extends downward from the upper edge 5, preferably to about halfway up the trapezoid. The front sight 2 likewise has a contrast strip 21, which is at the same height as the first contrast strip. These strips may be white, black-colored or else luminous. They assist target acquisition in various poor light conditions.

The embodiment in FIG. 3 differs from the preceding embodiment primarily by the curved trapezoid sides 8', 9' and triangle sides 11', 12', as a result of which curved unobstructed gaps 15', 16' are produced. In addition, the contrast strips 30, 31 may be of different shapes. They each form an arrow which lines the edges 5, 8' or 5, 9' or 11', 12'. Instead of the arrows 30, 31, the edges could also be lined by contrast strips over their entire length.

When aiming at the target point 13, the tip 10 is moved to the level of the upper edge 5 and is placed on the target point 13, for elevation aiming. For azimuth aiming, either the tip 10 is moved precisely to the center of the upper side 7, or the two unobstructed gaps 15, 16 are made to be of equal width. It is thus impossible for the weapon to be tilted. When matching the width of the two unobstructed gaps 15, 16, the eye is drawn directly to the target point 13 by the convergence of these gaps.

While the unobstructed gaps in FIG. 3 are concave with respect to the vertical axis of symmetry, those in the exemplary embodiment according to FIG. 4 are convex, since the sides 8", 9", 11", 12" are curved in the opposite direction.

As is normal in the case of sharp edges when machining metals, the tip 10 can be chamfered or very slightly rounded.

I claim:

1. An aiming device for handheld firearms comprising a rear notch sight and a front sight, in which case there are unobstructed gaps between the mutually facing boundaries of the rear notch sight and the front sight, in which case the rear notch sight has an essentially trapezoidal rear notch sight cutout which diverges downward from an upper edge, and the front sight has an essentially triangular outline, whose upper tip, when the weapon is being aimed, bisects the upper side of the trapezoidal rear notch sight cutout, so that an unobstructed gap is formed in each case between the sides of the trapezoidal rear notch sight cutout and the sides of the triangular outline of the front sight, wherein the unobstructed gaps are inclined at about 45 degrees to the vertical whereby the inclination and width of the unobstructed gaps reduce aiming errors in both the azimuth direction and the elevation direction, wherein contrast strips are arranged in the upper region of the rear notch sight and of the front sight and entirely or partially line the sides of the trapezoidal rear notch sight cutout and the sides of the triangular outline of the front sight.

2. The aiming device as claimed in claim 1, wherein the contrast strips are luminous.

3. The aiming device as claimed in claim 1, wherein the sides of the essentially trapezoidal rear notch sight and those sides which originate from the tip of the front sight each run in a curved shape.

4. The aiming device as claimed in claim 1, wherein the sides of the front sight have concave curvature.

* * * * *